United States Patent [19]

Rossfelder

[11] 3,968,579

[45] July 13, 1976

[54] APPARATUS FOR SEDIMENT DREDGING AND OCEAN MINERAL GATHERING

[76] Inventor: André M. Rossfelder, 1805 Crespo Drive, La Jolla, Calif. 92037

[22] Filed: Feb. 24, 1975

[21] Appl. No.: 552,363

[52] U.S. Cl. ..... 37/69; 299/9; 114/206 R; 198/116

[51] Int. Cl.[2] ..... E21C 3/00

[58] Field of Search ..... 37/69, DIG. 8, 83; 198/116; 299/8, 9; 114/206 R

[56] References Cited

UNITED STATES PATENTS

| | | | |
|---|---|---|---|
| 117,109 | 7/1871 | Platt | 37/69 |
| 125,351 | 4/1872 | Thelin | 37/69 |
| 610,763 | 9/1898 | Kibling | 37/69 |
| 3,378,130 | 4/1968 | Wallace | 37/69 X |
| 3,588,174 | 6/1971 | Rossfelder | 299/8 |
| 3,672,079 | 6/1972 | Masuda et al. | 37/69 |
| 3,811,730 | 5/1974 | Dane, Jr. | 37/DIG. 8 X |

FOREIGN PATENTS OR APPLICATIONS

| | | | |
|---|---|---|---|
| 1,000,273 | 2/1952 | France | 37/69 |
| 1,239,178 | 7/1971 | United Kingdom | 37/69 |
| 267,775 | 3/1927 | United Kingdom | 37/69 |

*Primary Examiner*—E. H. Eickholt
*Attorney, Agent, or Firm*—Romney Schaap Golant Scillieri & Ashen

[57] ABSTRACT

An underwater mining or dredging apparatus having a supporting vessel and a continuous loop to which is attached a number of containers. In one embodiment, the loop is hollow and has a ballasted fluid in a lower portion while the descending portion is buoyant. This will reduce the likelihood of entanglement of the loop. In another embodiment, a weight sled is used to help gather the underwater aggregates and prevent wear of the loop. The loop may be designed to hydrodynamically resist entanglements and may be disposed laterally relative to the supporting vessel.

15 Claims, 25 Drawing Figures

FIG. 4e.
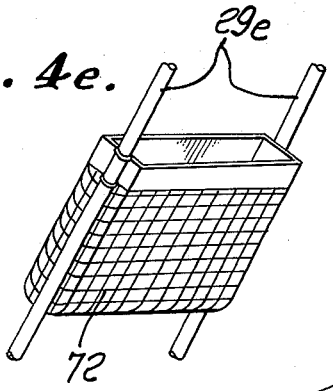
FIG. 4f.
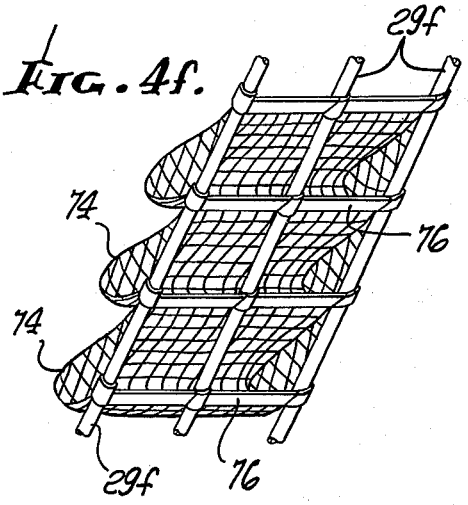
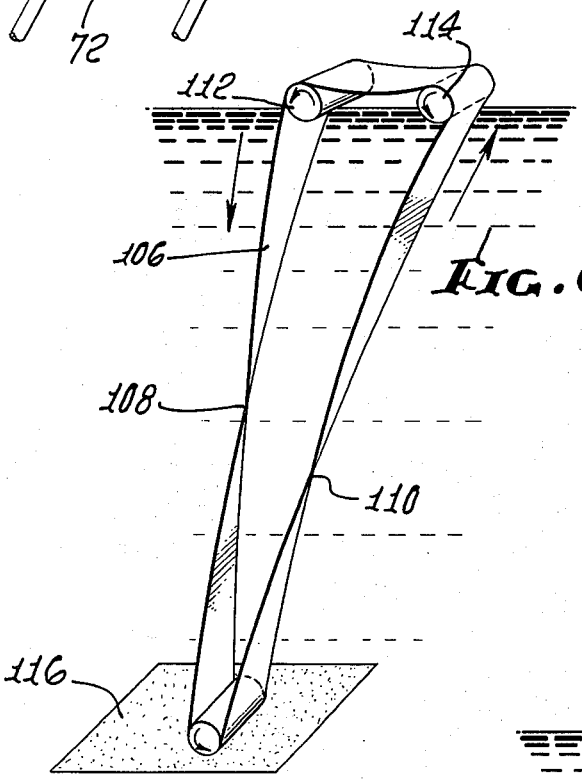
FIG. 6a.
FIG. 6b.
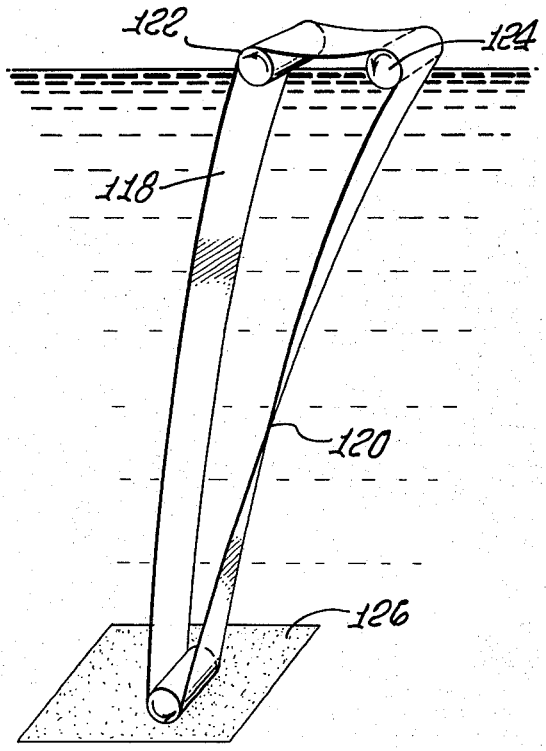
FIG. 5.
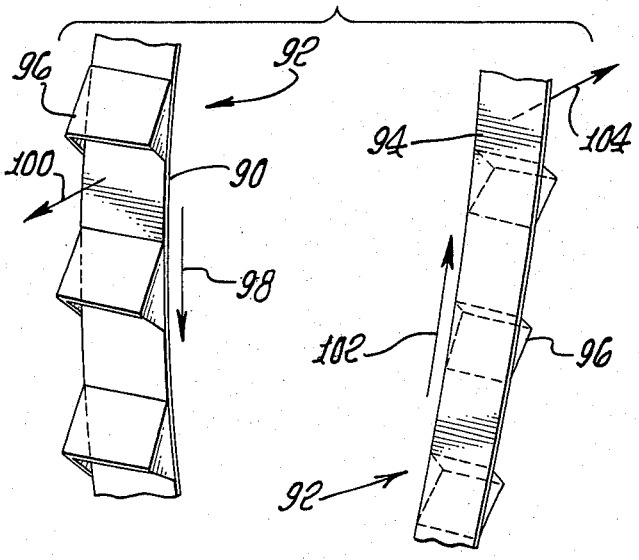

APPARATUS FOR SEDIMENT DREDGING AND OCEAN MINERAL GATHERING

BACKGROUND OF THE INVENTION

1. Field of the Invention

The present invention relates to the acquisition of underwater aggregates, and more particularly to an apparatus for use in gathering and collecting nodules from the ocean floor and for use in dredging in either deep or shallow water. Collecting nodules from the ocean floor is commonly referred to as "ocean mining".

2. Description of the Prior Art

It has long been known that available minerals exist on the ocean floor in the form of ferromanganese nodules. These are relatively small aggregated lumps of minerals, usually including copper, nickel and cobalt, which are found over large extents of the ocean floor, frequently at depths of 12,000 to 16,000 feet. With the growing scarcity of natural resources, these undersea mineral deposits have attracted an increasing amount of attention. And, because of the rising cost of these minerals, their mining is now considered economically feasible.

Over the last decade, many patents have issued on systems for mining these undersea mineral deposits. For the most part, these systems have included a generally vertical conduit which moves along the ocean floor sucking upwardly the minerals along with a large amount of water. Again, for the most part, these systems have not proven to be fully satisfactory.

Presently, the system that offers an excellent chance of success is one having an endless loop to which is attached a number of buckets. The loop is paid out from a surface vessel, sent to the ocean bottom and then retrieved by the same surface vessel in a vertical conveyor-belt manner. One such system is shown in U.S. Pat. No. 3,672,079, for example.

While the continuous bucket system offers promise, there are certain problems which have prevented its adoption for commercial mining operations. A major problem is that of the descending and ascending portions of the loop becoming entangled. Another problem has been the developement of an appropriate loop structure which will prove reliable in a relatively hostile undersea environment. Still another problem is the development of an appropriate bucket size and configuration so that the mineral-gathering operation can be optimized.

Dredging has also proven to be a problem, eespecially in deep water. Present dredging systems have been relatively inflexible and therefore limited to a working depth of some 50–60 feet. Today there is a need for deep sea dredging to depths of 150–160 feet in order to accommodate the new and huge supertankers presently being used and built. Today, supertankers must load and unload at an offshore facility because the draft of the vessels is too large to be accommodated in most harbors. In certain areas, even such offshore activity is difficult. For example, off Louisiana and Texas, the U.S. continental shelf extends for more than 100 miles, and it is not uncommon for the water depth to be less than 150 feet as far as 50 miles from land. For a ship having a draft of 150 feet, a deep channel must be provided to allow the ship to approach anywhere near land. Because of this dredging depth, existing dredge systems are unworkable due to the high induced stresses such a system would face. Even in relatively shallow water, overstressing of the dredge system is not uncommon.

SUMMARY OF THE INVENTION

The present invention is an apparatus for gathering undersea mineral aggregates and solves the problems mentioned above while at the same time providing reliability and economy. The inventive apparatus comprises a supporting vessel having means for holding a loop element; a loop element movable between the vessel and an aggregate-gathering position for transporting aggregates from the ocean floor to the vessel, the loop having an upper descending portion, a lower portion and an upper ascending portion wherein the upper descending portion is buoyant and the lower portion is weighted; and means attached to the loop element for holding the aggregate during ascent from the ocean floor to the vessel.

A primary aim of the present invention is to provide an undersea mineral aggregate gathering apparatus which is reliable and economical so as to be commercially viable; the invention is equally suited for undersea mining or underwater dredging.

More specifically, one aspect of the present invention is to provide an apparatus for gathering underwater aggregates having a continuous loop element and attached containers constructed to reduce the likelihood of the loop becoming entangled.

Another aspect of the present invention is to provide an apparatus that is adaptable for deep sea dredging as well as dredging in shallow water.

The foregoing objects, advantages, features and results of the present invention, together with various other objects, advantages, features and results thereof which will be evident to those skilled in the art in the light of this disclosure, may be achieved with the exemplary embodiments of the invention described in detail hereinafter and illustrated in the accompanying drawings.

BRIEF DESCRIPTION OF THE DRAWINGS

In FIG. 2*a* the loop element is shown as it would be at or near the surface of the sea where pressure is relatively low; in FIG. 2*b* the loop is illustrated at a greater depth where the pressure is sufficient to cause collapse; and in FIG. 2*c*, the loop is illustrated near or at the ocean floor where a ballasting fluid is present.

In FIG. 3*a* the loop element is depicted as it would be at or near the surface of the sea where the pressure is relatively low, while in FIG. 3*b* the loop element is depicted at a greater depth where the sea pressure is sufficient to collapse the loop.

FIGS. 4*a*, 4*b*, 4*c*, 4*d*, 4*e*, and 4*f* are diagrammatic perspective views of various containers for holding underwater aggregates during their transportation from the ocean floor to a collection vessel; the container shown in FIG. 4*a* represents a prior art version.

FIG. 5 is a diagrammatic perspective view of a portion of a loop element including attached containers for the purpose of illustrating the action of hydrodynamic forces acting on the loop.

FIGS. 6*a* and 6*b* are diagrammatic illustrations of two embodiments of loop elements. FIG. 6*a* illustrates a double twisted loop element while FIG. 6*b* illustrates a single twisted loop element in the form of a Möbius band.

DESCRIPTION OF THE PREFERRED EMBODIMENTS

Figure 1:
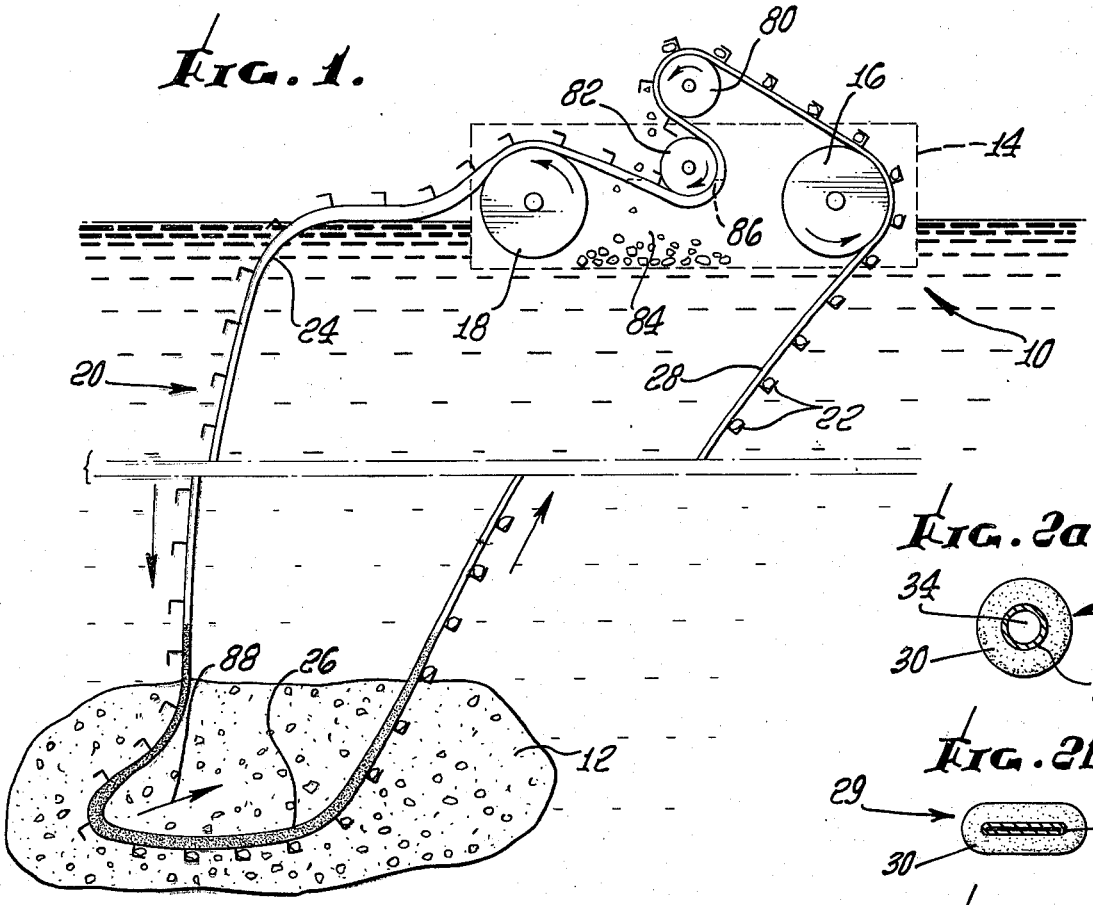
FIG. 1 is a diagrammatic elevational view illustrating an embodiment of an apparatus for collecting underwater mineral-aggregates.

While the present invention is susceptible of various modifications and alternative constructions, illustrative embodiments are shown in the drawings and will herein be described in detail. It should be understood, however, that it is not the intention to limit the invention to the particular forms disclosed; but on the contrary, the invention is to cover all modifications, equivalences and alternative constructions falling within the spirit and scope of the invention as expressed in the appended claims.

Referring now to FIG. 1, there is illustrated diagrammatically the apparatus 10 for gathering undersea mineral-aggregates located on the underwater floor 12. The term "mineral aggregates" covers both unconsolidated sediment and underwater minerals. This emphasizes the dual nature of the present invention which may be used for underwater dredging or ocean mining. Aggregates include mud, silt, sand, gravel and nodules, and these may vary in size from one micrometer to ten centimeters. Generally, the apparatus 10 comprises a support vessel 14 having two main sprockets 16 and 18 for supporting a loop element 20 which extends from the supporting vessel to the underwater floor. Attached to the loop element is a plurality of containers 22 for holding mineral-aggregates during transportation from the floor to the supporting vessel.

Figure 15:
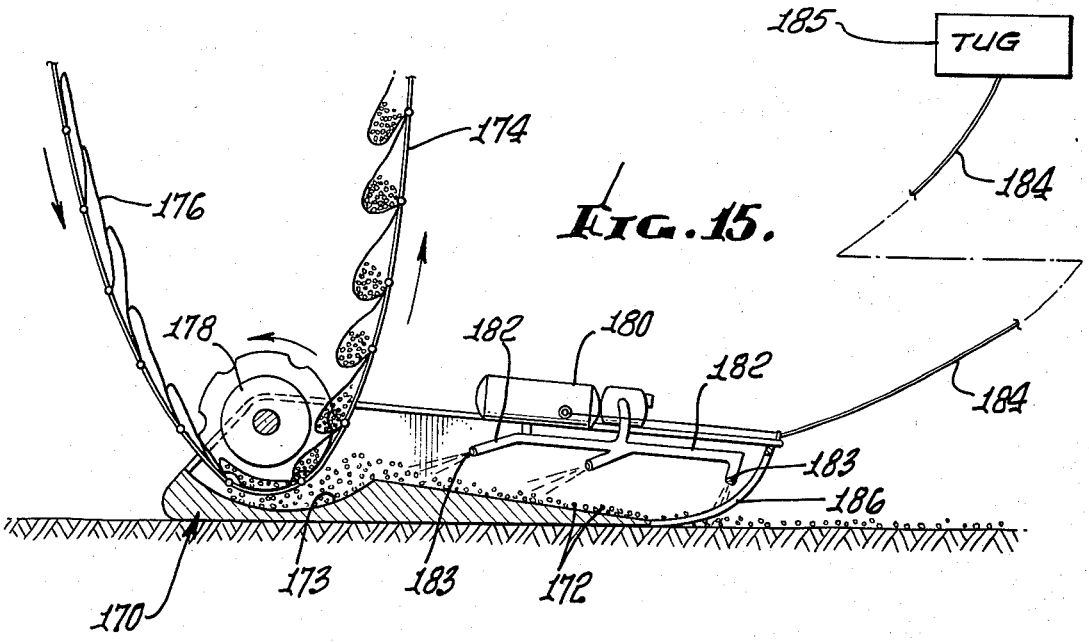
FIG. 15 is a diagrammatic elevational view of a weighted sled in operation at the ocean floor, the sled being towed by an independently movable satellite vessel.
Figure 16:
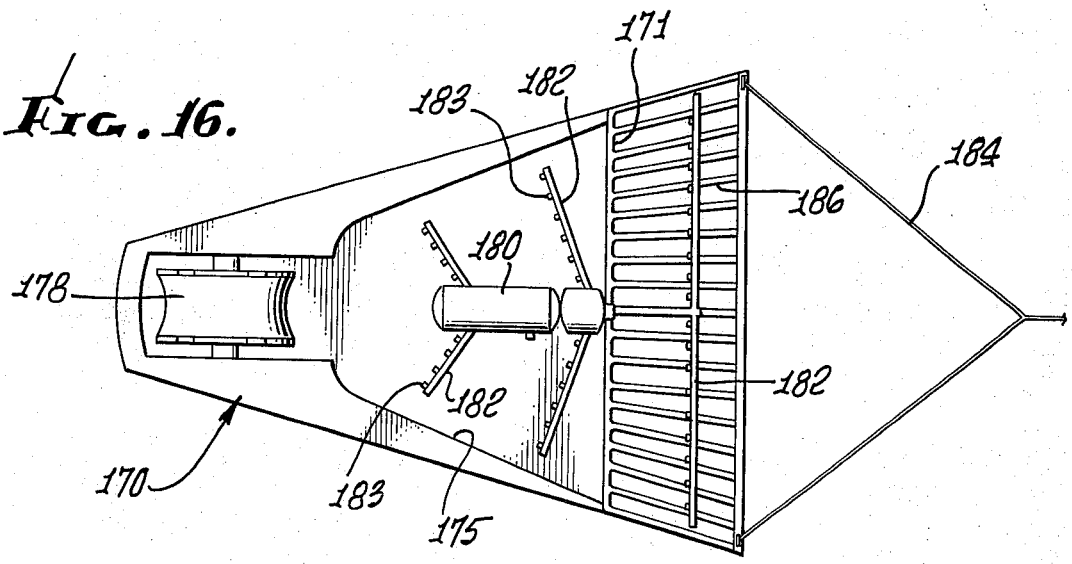
FIG. 16 is a diagrammatic plan view of the weighted sled shown in FIG. 15.

The loop element 20 may be divided into a descending portion 24, a lower portion 26, and an ascending portion 28. Each of these portions functions in a different and unique manner. The descending portion 24 is to be buoyant so that it will extend away from the supporting vessel as the loop is extended from the vessel. The lower portion 26 is weighted in order to insure contact with the aggregates at the underwater floor; this may be contact directly with the floor as shown in FIG. 1 or may be contact with a sled as shown in FIGS. 15 and 16. When the loop is in this latter-disclosed situation, it has been defined as being in an aggregate-gathering position. The ascending portion 28 of the loop element will have a negative buoyancy in view of the load being carried by the containers 22. As can be readily seen from FIG. 1, the advantage achieved by having a buoyant portion 24 is that due to the composite forces resulting from surface currents, vessel heading and vessel drift, as well as drag of the water upon the loop, there will be a greater separation between this portion and the ascending portion 28 so as to greatly reduce the possibility of entanglement.

Figure 2A:
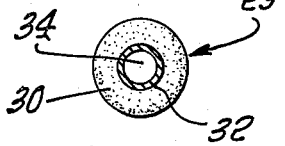
FIGS. 2*a*, 2*b* and 2*c* are enlarged cross-sectional views of one embodiment of a loop element.
Figure 2B:
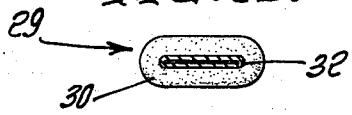
Figure 2C:
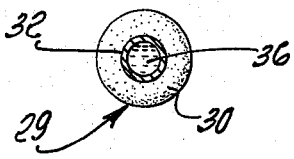

Referring now to FIGS. 2*a*, 2*b* and 2*c*, there is illustrated in more detail an embodiment of the loop element. As shown, this loop element is tubular in shape having an outer annular layer 30 of high strength and neutrally buoyant material, perhaps of organic fibers such as nylon, polypropylene, polyester, aramids, etc., an inner annular layer 32 of a gas-impermeable material and a central interior space 34 which may be filled with gas, such as air, to create buoyancy. While the loop is at or near the surface of the ocean, the geometric shape will be like that shown in FIG. 2*a*. However, as the loop descends, the increased ocean pressures will tend to collapse the loop to that configuration shown in FIG. 2*b*. In order to alter the loop from one having a buoyant characteristic to that having a ballasted characteristic, a ballasting fluid 36 such as oil drilling mud or even mercury may be used to fill the interior space 34. It is to be understood that when the loop is endless and having a continuous interior space 34, filling the lower portion 26, FIG. 1, with a heavy fluid (depicted in the drawing by darkening the lower portion of the loop), the fluid will tend to remain in and define the lower portion of the loop simply because of its weight. This means that the remainder of the loop will continue to have a buoyant characteristic while only the lower portion of the loop will be in a ballasted condition. It is also to be noted that unlike prior art dredging systems, the loop is foldable for easy storage when not in use.

It is noted that both the gas and the heavy ballasting fluid will increase rigidity of the loop at their respective locations in much the same way as an inflated tire and a sausage are more rigid than an empty tube or casing. This increase in rigidity in the two locations which essentially control the spreading of the loop tends to reduce the likelihood of entanglements.

Figure 3A:
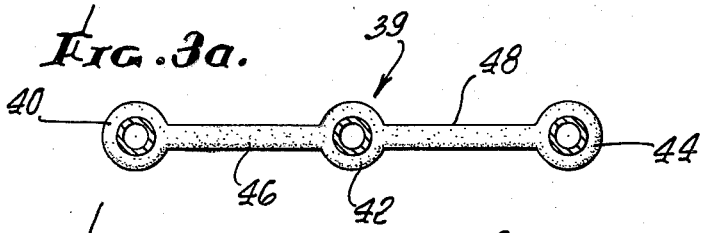
FIGS. 3*a* and 3*b* are cross-sectional views of another embodiment of a loop element.
Figure 3B:
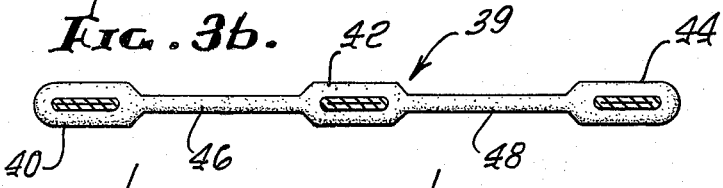

FIGS. 3*a* and 3*b* illustrate another embodiment of a loop 39 showing three tubular sections 40, 42 and 44 having the same construction as that illustrated in FIG. 2*a*, aligned together with connecting webs 46 and 48 of high strength material. As explained above, with regard to FIGS. 2*a*–2*c*, when the loop 39 is at or near the surface where the pressure is relatively small, the configuration shown in FIG. 3*a* will be assumed. However, as the loop descends to a greater depth where the pressure increases, the interior air space will be squeezed so that the loop will take on the form as shown in FIG. 3*b*. Also, as explained with regard to FIGS. 2*a*–2*c*, a heavy fluid (not shown) may be provided in each of the sections 40, 42 and 44 to ballast the lower portion of the loop 39. As will be explained hereinbelow, a choice as to which loop to use, either that shown in FIGS. 2*a*–2*c* or that shown in FIGS. 3*a*–3*b*, may depend upon the container which is used in conjunction with the loop. The advantage of the wider loop 39 as compared to the tubular loop 29 is that a wider containing having a greater capacity may be used. It is further to be understood that instead of the wide loop 39, a loop may be constructed of two identical elements, each constructed like the element 29, placed parallel to one another. Yet another alternative is to coordinate two loops, one of which has a structure like that shown in FIG. 2*a* while the other loop is made of high strength material only. This provides a combination of buoyancy plus greater strength.

Figure 14:
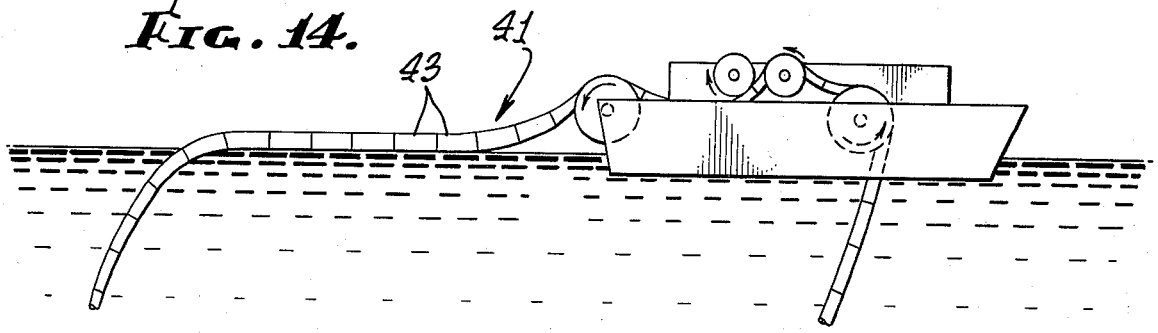
FIG. 14 is a diagrammatic elevational view of a supporting vessel and a loop element divided into a plurality of gas cells.

FIG. 14 illustrated diagrammatically a loop 41 which is shown divided into a number of independent cells 43. This arrangement will insure that the loop will be able to maintain the buoyant portion even after long usage. It is of course appreciated that with such a construction, the internal heavy fluid as described for the FIG. 2 embodiment can no longer be used. However, ballast can be provided by use of a sled which will be described hereinbelow in relation to FIGS. 15 and 16.

It can now be appreciated that with regard to the loop element, what has been disclosed is simple, reliable and economical.

Figure 4A:
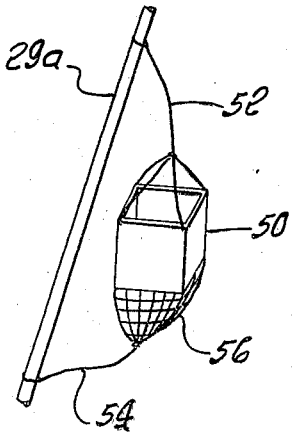
Figure 4B:
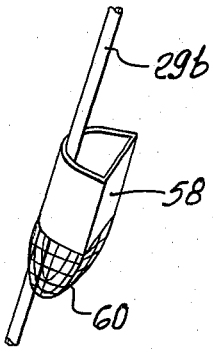
Figure 4C:
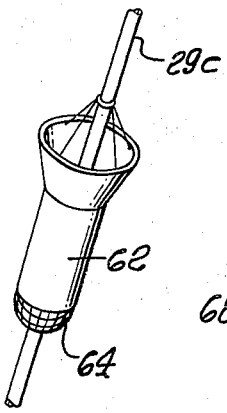
Figure 4D:
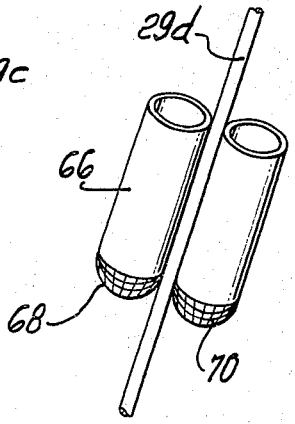

Referring now to FIGS. 4*a*–4*f*, there are illustrated a number of different container embodiments. Each of these containers is attachable to a loop element for transporting ocean floor nodules to the supporting vessel. In FIG. 4*a*, there is illustrated a prior art hanging container 50 which is suspended by cables 52 and 54 from a loop 29*a*. As with all of the containers, the hanging container 50 includes a net or wire mesh bottom 56 to allow the draining of water and sediment while retaining the ferromanganese nodules containing the valuable ores. FIG. 4*b* illustrates a sideway-disposed container 58 attached to the element 29*b* and having a mesh bottom 60. FIG. 4*c* illustrates a concentric container 62 having a mesh bottom 64 and disposed in a concentric manner about the loop 29*c*. FIG. 4*d* illustrates a dual container 66 having mesh bottoms 68, 70 connected to the loop 29*d*. FIG. 4*e* illustrates a container 72 primarily of mesh which is attached to and between a double element loop 29*e*. Finally, FIG. 4*f* illustrates a triple element loop 29*f* to which is connected mesh containers or sacks 74 separated by transverse scraping blades 76 for dislodging and directing the undersea nodules into the sacks. For dredging of underwater sediments, containers with mesh bottoms as shown in FIGS. 4*a*–4*f* would be replaced with containers having solid bottoms or a container filled with a tight bag. It can now be appreciated that the conntainers like the loop are relatively simple, inexpensive and reliable; this helps to achieve an economical system.

Returning again to FIG. 1, the supporting vessel has in addition to the two main sprockets 16 and 18, two smaller unloading sprockets 80 and 82. As shown, sprocket 16 pulls the ascending portion of the loop upwardly, before the loop passes to the sprocket 80. The sprocket 80 is located at an elevated position relative to the sprocket 82, so as to cause the containers to undergo a change of direction of approximately 180°, thereby dumping the load of minerals into the collection section 84 of the vessel. Thereafter, the loop travels around the sprocket 82 and then on to the releasing or payout sprocket 18.

An additional feature of the apparatus is the use of a fluid lock. This is simply a placement of a fluid 86 in that portion of the loop between the sprocket 18 and the sprocket 80. Because of the different elevational levels of the sprockets, the fluid will remain in the same relative position due to gravity. Such a fluid lock will ensure that the gas providing the buoyancy remains trapped in the portion of the loop paid out by the sprocket 18.

While it is not intended to limit the invention herein, it is assumed that the supporting vessel will be moving in a direction to the right in the depiction of FIG. 1 so that the buoyant descending portion 24 of the loop will tend to trail behind the vessel before descending to the ocean floor. This has the advantage of decreasing the likelihood of tangling with the ascending portion 28 of the loop. However, it should be remembered that even though the vessel is moving in a rightward direction, ocean currents will cause a sideways drift causing the resultant movement of the vessel relative to the ground to be somewhat different from that of its compass heading. The net result will be that the loop will tend to sweep the sea floor in a direction illustrated by the arrow 88. Because of this, it is determined that a large number of smaller containers, such as those shown in FIGS. 4*a*–4*f*, is more desirable than a smaller number of very large or wider containers.

Another factor that may be used to eliminate or at least sharply reduce the probability of loop entanglement is the shape of the loop and its attached containers. The containers may be designed to use the inherent hydrodynamic characteristics developed by the movement of the loop through the water. This causes opposing forces to be generated on the loop, resulting in a greater degree of separation. For example, referring now to FIG. 5, there is depicted on the left a descending portion 90 of a loop 92 while on the right is shown the ascending portion 94 of the same loop. By structuring the containers 96 as shown and moving them in a downward direction depicted by the arrow 98, a hydrodynamically generated "lifting" force will be generated as depicted by the arrow 100. In a like manner, moving the ascending portion of the loop as depicted by the arrow 102 will generate a generally opposite lifting force shown by the arrow 104. These forces will tend to bias the ascending and descending portions of the loop apart so as to enhance the separation of the loop. hydrodynamically generated forces may also be achieved by structuring the blades 76 and/or the sacks 74, FIG. 4*f*, in a manner analogous to that of the containers 96, thereby also enhancing separation of the loop.

FIGS. 6*a* and 6*b* illustrate two further embodiments of loop construction. There are bands provided with containers (not shown) such as those shown in FIGS. 4*e* and 4*f*. The loop 106 of FIG. 6*a* includes two full twists 108 and 110 between the position where the loop will contact the supporting vessel (as depicted diagrammatically by the two sprockets 112 and 114) and the underwater floor (as depicted by the plane 116). For such a loop, containers of the type illustrated in FIG. 4*f* will be most appropriate. In a similar depiction, FIG. 6*b*, the loop 118 has only one twist 120 between the supporting vessel depicted by the sprockets 122 and 124 and the underwater floor illustrated by the plane 126. For this loop, containers of the type illustrated in FIG. 4*e*, which can function from either side, will be most appropriate. The advantage of such twists is that the "sail" effect from underwater currents may be different on the loaded ascending portion than on the relatively buoyant descending portion, and thus may be used for increasing the spread between these two portions, thereby decreasing the likelihood of tangling. Secondly, the twists may be used for achieving simplified dumping and collection on board the supporting vessel. With regard to the FIG. 6*a* loop, the containers on the outer side of the loop at the underwater floor will end up on the inner side of the loop after going through the twist 110. By passing the loop over the sprocket 114, unloading is accomplished by gravity.

Even though the container is on the inner side of the loop after it passes the sprocket 112, the second twist 108 will place the container again on the outer side of the loop at the underwater floor. In the one Twist FIG. 6*b* embodiment, there will be a need to place a set of containers on each side of the loop and each set will alternate, or as mentioned, the construction shown in FIG. 4*e* may be used.

Figure 13:
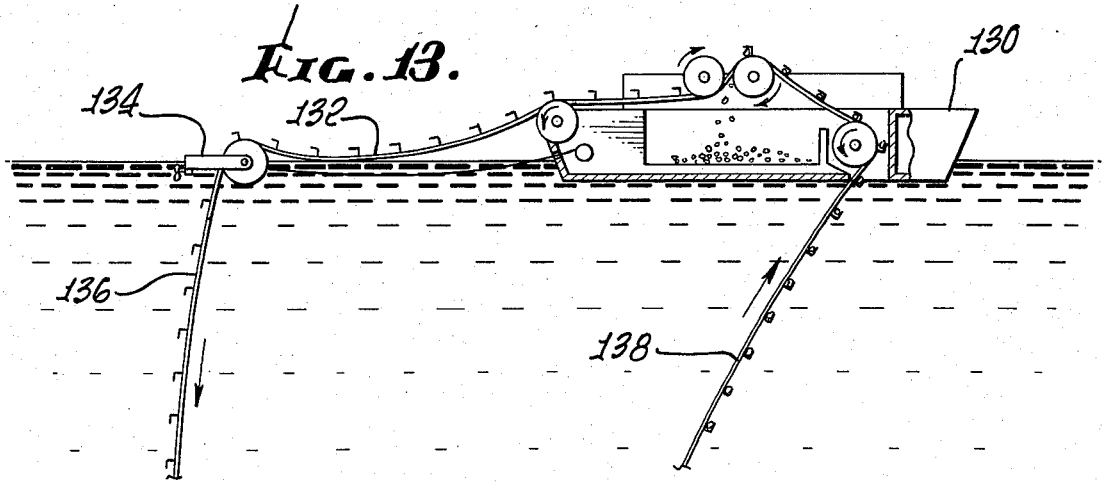
FIG. 13 is a diagrammatic elevational view of a supporting vessel and a buoyant satellite vessel.

Referring now to FIG. 13, there is illustrated a main supporting vessel 130, a loop 132, and a buoyant satellite vessel 134. This satellite vessel is at a distance from the main supporting vessel (and could be either behind, in front of or to the side of the vessel 130) and as shown, may be powered and have control surfaces for independent movement. The main function of such a buoyant satellite vessel, provided with propulsion means, is to assist the descending portion 136 of the loop away from the vessel 130 and from the ascending portion 138, further diminishing the risks of entanglement. This may be best accomplished by having the vessel 134 drive in an opposite direction from the vessel 130.

Figure 7:
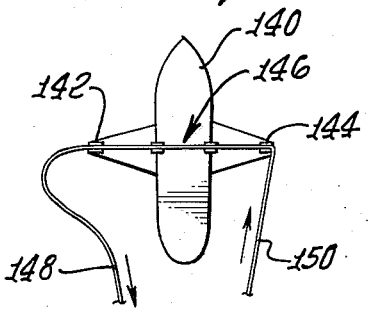
FIGS. 7 and 8 are diagrammatic plan and elevational views, respectively, showing a loop element laterally disposed relative to its supporting vessel.
Figure 9:
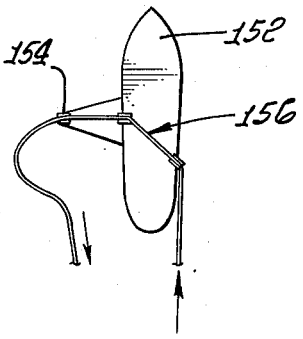
FIGS. 9 and 10 are diagrammatic plan and elevational views, respectively, showing a loop element partially laterally disposed relative to its supporting vessel.
Figure 11:
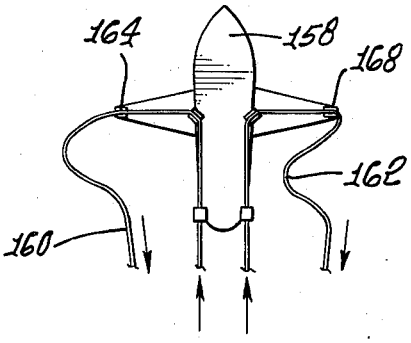
FIGS. 11 and 12 are diagrammatic plan and elevational views, respectively, showing two loop elements, each laterally disposed relative to the supporting vessel.
Figure 8:
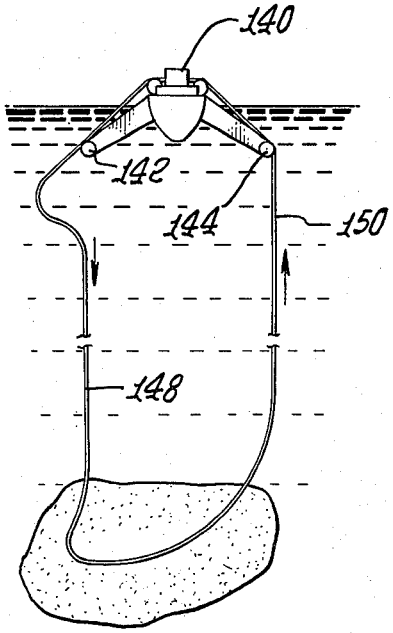
Figure 10:
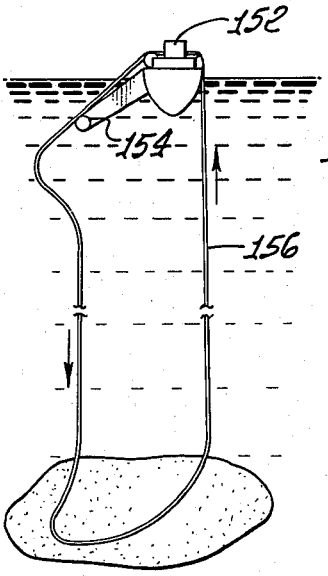
Figure 12:
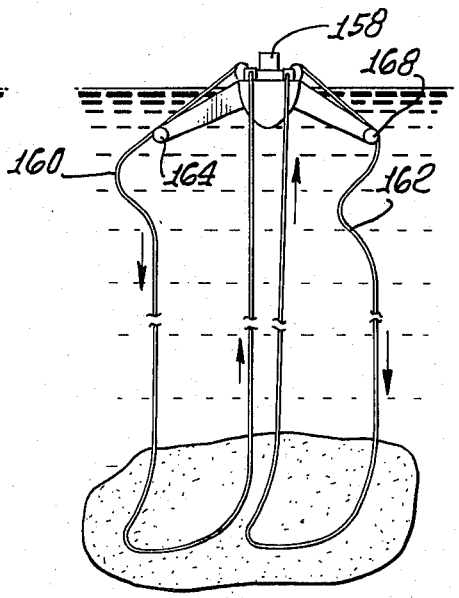

As shown in FIGS. 7–12, the buoyant satellite vessel may be rigidly linked to the support vessel by a cantilever beam and posiitoned laterally relative to the supporting vessel. FIGS. 7 and 8 illustrate a supporting vessel 140 having two laterally placed satellite vessels 142 and 144. A loop 146 is shown laterally crossing the vessel 140 and having a descending portion 148 on the left side and an ascending portion 150 on the right side. Another variation is shown in FIGS. 9 and 10 in which a supporting vessel 152 has a single laterally-disposed satellite vessel 154 to its left and a loop 156 having descending and ascending portions as shown by the arrows. FIGS. 11 and 12 illustrate a supporting vessel 158 having a double loop arrangement 160 and 162. These are supported by the vessel 158 as well as by satellite vessels 164 and 168. Again, the ascending and descending portions of the loops can be determined by the arrows in the drawing.

Referring now to FIGS 15 and 16, there is illustrated a weighted sled 170 having a scraping edge 171 for directing and guiding underwater minerals illustrated by the small lumps 172 along a tapered channel 175 toward a trough 173 through which passes a loop 174 having bag-like containers 176. The loop is positioned to go around a sprocket 178 which is attached to the sled 170. It is noted that in this arrangement the loop itself does not come into actual contact with the underwater (ocean) floor, but rather simply collects the minerals which are directed to it by the sled. There are two major advantages with this embodiment, the first of which is that the loop will not wear as quickly, since it merely passes through a mineral-gathering position as shown in FIG. 15. A second advvantage is that a specially designed weighted sled can better dislodge the desired minerals from the ocean floor than could a container attached to a loop.

As shown in FIG. 16, the sled 170 has a triangular shape in plan view so that the minerals gathered are converged toward the sprocket 178 where the loop containers can easily gather the minerals. The sled is also provided with a motorpump system 180 for supplying a jet stream of water through appropriate conduits 182 and nozzles 183 for initially helping to dislodge the minerals from the ocean floor and then for separating the valuable minerals from undesirable sediment. Another advantage of a sled is that it may be towed by a cable 184 linked to a separate tender vessel, such as a tug (illustrated by the block 185, FIG. 15). The tug may deploy and handle the sled so as to transfer the stresses due to the towing function from the support vessel and the loop to the towing cable and the tug. Furthermore an independent tow will insure against loss of the sled. If either the loop or tow cable breaks the sled can still be retrieved. The cable 184 may be provided with an electrical conductor for the motorpump 180 and any TV or sensing and control devices on the sled.

A grill 186 may also be provided as a protective bumper against obstacles and for pushing aside any oversize nodules. Another major advantage of the use of a sled is that the rotational velocity of the loop may be independent of the ground speed of the sled. For example, the ground speed of the sled can be adjusted as a function of the density of the aggregates while the rotational velocity of the loop can be independently adjusted to the rate of aggregate collection. A still further advantage is that the width of the sled can be made several times that of the width of the loop so that a wider path may be mined or dredged.

While the various support vessels illustrated relate to surface vessels, it is to be understood that the supporting vessel may be completely submerged or semi-submerged and may be in the form of a standard ship or may have any one of a variety of shapes such as catamaran or tri-maran.

Operation of the apparatus, as already explained, is simple and reliable. This allows for the economy necessary to have commercial exploitation. It is now clear that what has been described is an apparatus for mining undersea minerals or dredging, both in a commercially economical manner. The apparatus described is relatively simply constructed and highly reliable in view of the rather unique and hostile environment in which it must work.

I claim:

1. An apparatus for gathering underwater mineral aggregates comprising:

a. a supporting vessel having means for handling a loop element;

b. a loop element movable between said vessel and an aggregate-gathering position for transporting said aggregates from the ocean floor to said vessel, said loop having an upper descending portion, a lower portion and an upper ascending portion wherein said upper descending portion is buoyant and said lower portion is weighted; and c. means attached to said loop element for holding said aggregates during ascent from the ocean floor to said vessel.

2. An apparatus as claimed in claim 1 wherein said loop element comprises a plurality of tubular shaped members, each of said members connected to an adjacent member with neutrally buoyant material.

3. An apparatus as claimed in claim 1 wherein said loop element has a tubular shape and is compressible.

4. An apparatus as claimed in claim 3 wherein said tubular shape includes a central opening and said central opening is divided into a plurality of gas-filled cells.

5. An apparatus as claimed in claim 1 wherein said holding means includes a plurality of containers attached to said loop element at spaced intervals, each of said containers having a large opening for receiving said aggregates and a plurality of smaller openings for allowing the passage of water.

6. An apparatus as claimed in claim 1 wherein said holding means includes a plurality of containers attached to said loop element at spaced intervals, each of said containers having a large opening for receiving said aggregates.

7. An apparatus as claimed in claim 1 wherein said holding means includes a plurality of containers attached to said loop element, said containers shaped to provide a hydrodynamic lifting force in a first direction when said containers are descending from said vessel to said aggregate-gathering position and in a second direction generally opposite to said first direction when said containers are ascending from said aggregate-gathering position to said vessel whereby the descending and ascending portions of said loop element are biased away from one another.

8. An apparatus as claimed in claim 1 wherein said loop element is twisted through an angle of 180°.

9. An apparatus as claimed in claim 1 including weighted means for directing and guiding aggregates to said holding means.

10. An apparatus as claimed in claim 9 including a satellite vessel spaced from said supporting vessel; and means linking said weighted means and said satellite vessel for allowing said satellite vessel to tow said weighted means.

11. An apparatus as claimed in claim 10 wherein said weighted means includes a scraping edge for movement along the ocean floor and a tapered channel for guiding said aggregates toward said holding means.

12. An apparatus as claimed in claim 11 wherein said weighted means includes a plurality of nozzles for directing a stream of water at said aggregates in said tapered channel.

13. An apparatus as claimed in claim 1 including at least two sprockets mounted to said supporting vessel for moving the loop element.

14. An apparatus as claimed in claim 13 including a buoyant satellite vessel spaced from said supporting vessel for supporting a portion of said loop element at a distance from said supporting vessel.

15. An apparatus as claimed in claim 14 wherein said buoyant satellite vessel is connected to and laterally disposed from said supporting vessel.

* * * * *